US006889945B2

(12) United States Patent
McCall

(10) Patent No.: US 6,889,945 B2
(45) Date of Patent: May 10, 2005

(54) TABLE TOP WINE HOLDER

(76) Inventor: Edward C. McCall, 22 Garnet Ct., Wayne, NJ (US) 07470

( * ) Notice: Subject to any disclaimer, the term of this patent is extended or adjusted under 35 U.S.C. 154(b) by 0 days.

(21) Appl. No.: 10/647,689

(22) Filed: Aug. 25, 2003

(65) Prior Publication Data

US 2005/0045778 A1 Mar. 3, 2005

(51) Int. Cl.[7] ..... A47F 5/02; A47F 5/12
(52) U.S. Cl. ..... 248/130; 248/141; 222/144
(58) Field of Search ..... 248/105, 107, 248/153, 312, 311.2, 309.1, 128, 130, 139, 141; 62/457.8, 457.1, 464, 457.4, 457.5; 211/74

(56) References Cited

U.S. PATENT DOCUMENTS 1,412,900 A * 4/1922 Spacke ..... 248/105
2,817,458 A * 12/1957 Amigone ..... 222/131
2,819,860 A * 1/1958 Orbach ..... 248/128
2,890,007 A * 6/1959 Rutledge, Sr. ..... 248/105
3,155,284 A * 11/1964 Forman et al. ..... 222/144
4,023,379 A * 5/1977 Zevlakis ..... 62/258
4,836,476 A * 6/1989 Wolf ..... 248/146
5,444,992 A * 8/1995 Bell ..... 62/372
5,609,318 A * 3/1997 Scheh ..... 248/311.2
5,890,686 A * 4/1999 Morales ..... 248/141
6,715,647 B1 * 4/2004 Ivins ..... 222/166

* cited by examiner

*Primary Examiner*—Leslie A. Braun
*Assistant Examiner*—Tan Le
(74) *Attorney, Agent, or Firm*—William R. Moran

(57) ABSTRACT

A holder for wine and other beverage bottles is provided which is appropriate for placement on a table top and is so designed as to be resistant to tipping over. The wine holder is comprised of a support base which rests on, and can be affixed to, a table top; a continuous elongated oval shaped vertical support frame which contains a cylindrical wine and coolant receptacle between the arms of the frame and wherein the receptacle can be rotated away from the vertical to access the wine bottle.

20 Claims, 5 Drawing Sheets

TABLE TOP WINE HOLDER

BACKGROUND OF THE INVENTION (1) Field of the Invention

This invention relates to a holder and for wine and other beverages which is appropriate for placement on a table top and is resistant to tipping over.

(2) Background Art

While it is sometimes appropriate to place bottles in which beverages are served directly on the table, when it comes to wine, one usually serves a red wine in a carafe or if the wine is a white wine to be served in a chilled state in an ice bucket placed next to the table from which it can be served to those seated at the table. Of course, red wines can also be placed on the table while still in the bottle if so desired.

While a true connoisseur of wines will prefer that red wines be served at room temperature in order to fully enjoy the aroma, bouquet and the like, white wines, champagne and similar beverages are usually chilled before serving. In most instances the wine steward or sommelier will dispense the wine as needed to the persons gathered at the table. In up-scale restaurants, only the sommelier or wine steward is the proper one to serve the wine.

Prior to the present invention, several patents have issued in the United States directed to wines and various methods for maintaining them in a chilled state during mealtime. For example, U.S. Pat. No. 4,388,813, discloses and claims a server for chilled wine and similar beverages or foods which includes a cylindrical-shaped side wall into which a wine bottle can be placed. The side wall is constructed of a heat conductive material such as aluminum, copper, alloys and the like. Ice contained in a receptacle is in contact with the side wall which presents a surface area at or below the desired serving temperature. A server for chilled wines is also disclosed in U.S. Pat. No. 4,393,665, which is an improvement on the server of U.S. Pat. No. 3,977,552.

Several other references show various cooling devices such as U.S. Pat. No. 4,023,379, which shows a portable wine cooler with a cylindrical shaped container with insulated walls. U.S. Pat. No. 4,023,379 shows a dining room table with a central refrigerated well for storing beverages. U.S. Pat. No. 5,415,010, discloses table assembles with refrigeration means.

However, none of the above references disclose a table top wine holder as hereinafter described which can be placed on a table top without fear of it being tipped over. It is therefore and object of this invention to provide a wine holder which can be placed on and affixed to the table at home or in a restaurant in close proximity to those seated around the table. Another object of this invention is to provide a wine holder which is of a unique design and allows consumers to easily help themselves rather than wait for the wine steward or sommelier to serve. Another object of this invention is to provide a wine holder which avoids the use of the standard ice bucket and the need to wrap the wet wine bottle in a towel so as to avoid dripping while serving. A further object is to have the wine within easy reach of those seated at table. Another object of this invention is to provide a stainless steel wine holder having means for assuring that the wine holder is in no danger of tipping and which is an attractive addition to the dinning table. These and other object will readily become apparent to those skilled in the art in the light of the teachings herein set forth.

SUMMARY OF THE INVENTION

In its broad aspect, the present invention is directed to a holder for wine or other beverage and which is appropriate for placing on the dinning table at both a restaurant or at home. The wine holder of the present invention is comprised of, in combination:

(a) a support base which can rest on, and has means to maintain the wine holder on a table top;

(b) at least one continuous, elongated support frame which is disposed so that the ends of the frame are affixed to the outer areas of the upper side of the support base, providing a continuous vertical loop over the base;

(c) horizontal support means rotatably attached to opposite arms of the support frame and supporting a cylindrical receptacle deposed between the arms of the support frame;

(d) means affixed to at least one of the support means to permit rotation of the cylindrical receptacle from the vertical up to about 20 degrees away from the vertical, and optionally to lock the cylindrical receptacle in place; and (e) removable cooling means associated with the wine receptacle for maintaining a wine bottle held within the receptacle at a temperature suitable for serving.

DETAILED DESCRIPTION OF THE PREFERRED EMBODIMENTS

Figure 1:
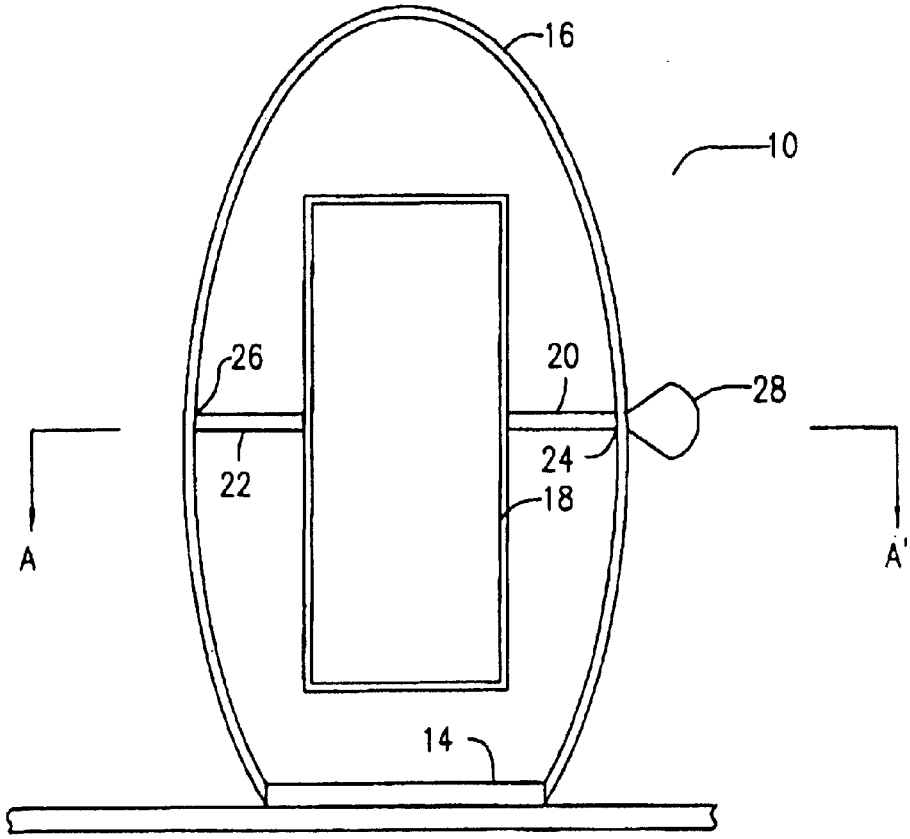
FIG. 1 is a side view of the table top wine holder of the present invention.

The present invention will be more readily understood by reference to the drawings wherein FIG. 1 is a plan view taken of the side of the table top wine holder 10 resting on table 12, not fully shown, and comprised of support base 14, elongated oval shaped support frame member 16, containing there between wine receptacle 18, rod rotation means 20 and 22, which permit receptacle 18 to rotate away from vertical around attachment points 24 and 26, and lever 28 to tilt receptacle 18 away from the vertical and affix it in the tilted position if desired.

Figure 2:
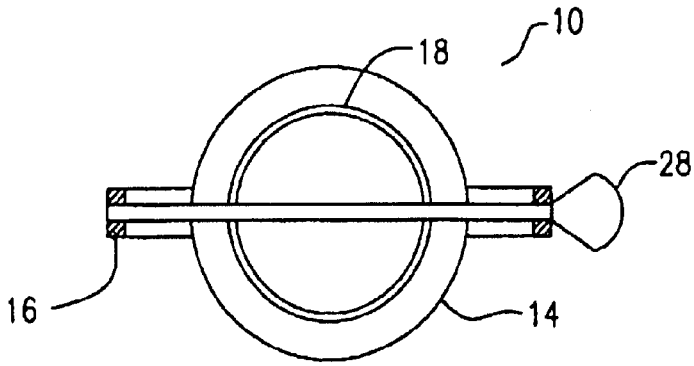
FIG. 2 is a top view of the wine holder taken through line A–A' of FIG. 1.

FIG. 2 is a top view of the table wine holder 10 of the present invention taken through A–A' without showing any of table 12, or the tubular sleeve which fits within receptacle 18. Rods 20 and 22 are directly under the top portion of support frame member 16, and hence not shown.

Figure 5:
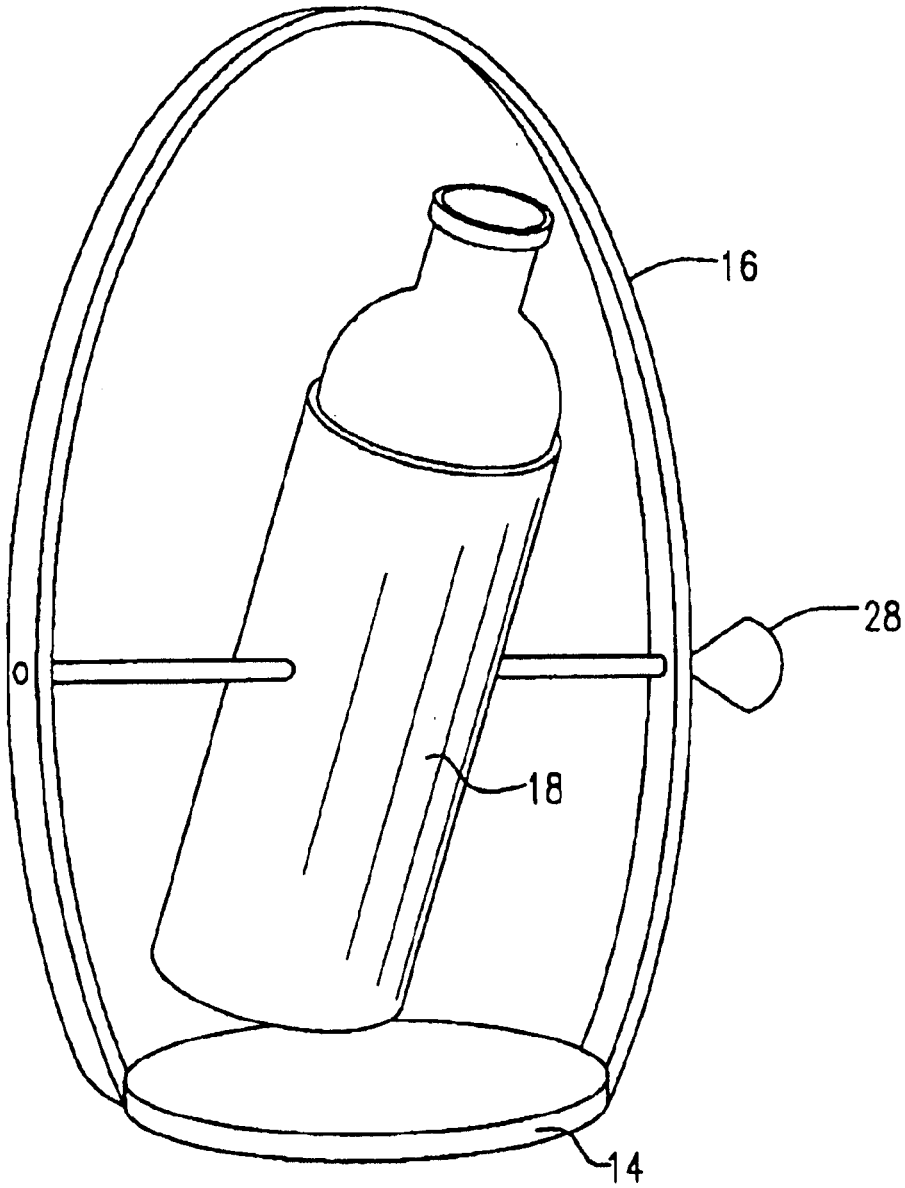
FIG. 5 is a perspective view of the table top wine holder showing a wine bottle positioned in a receptacle and tilter away from the support frame for ease of removal.

FIG. 5 is a perspective view of the table top wine holder of this invention showing wine receptacle 18 tilted away from the support frame member 16 by lever 28 which, if desired, can lock the cylinder 18 in the tilted position.

Figure 6:
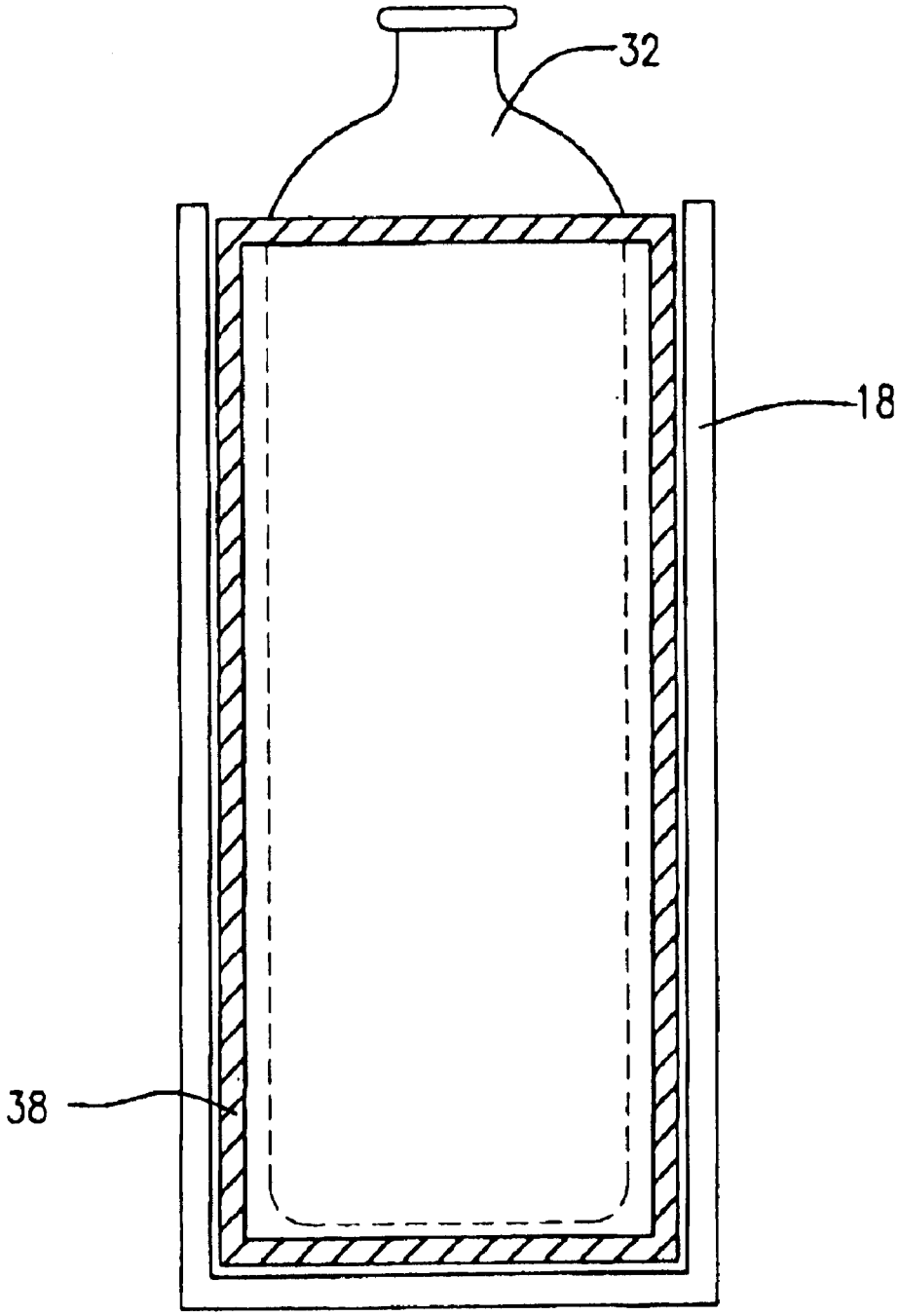
FIG. 6 is a cross-sectional view of the wine receptacle and inner tubular cooling sleeve with a wine bottle.

FIG. 6 is a cross-sectional side view of receptacle 18 which is cylindrical in shape, closed at the bottom and open at the top. Tubular sleeve 30 is shown in dotted line and a wine bottle 32 disposed inside tubular sleeve 30 which is contained within receptacle 18.

Figure 3:
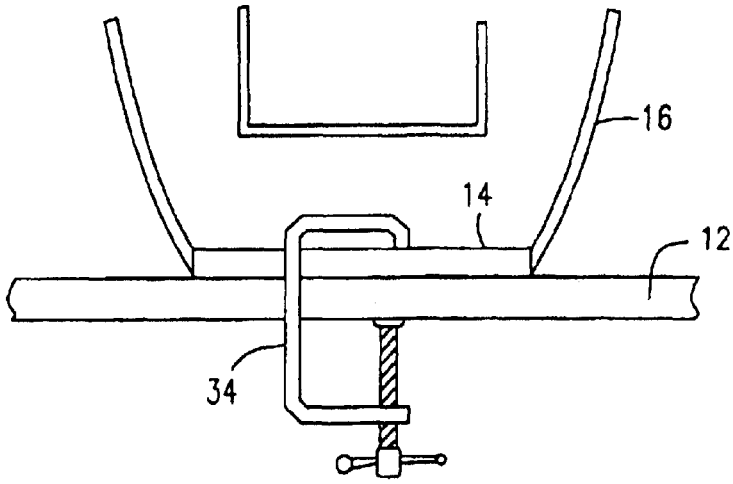
FIG. 3 depicts one means for attachment of the wine holder to a table by means of a clamp.

FIG. 3 depicts a side view of support base 14 and portions of support frame member 16 and one means for securing the wine holder firmly to the table top by means of a clamp, such as a "C" clamp 34.

Figure 4A:
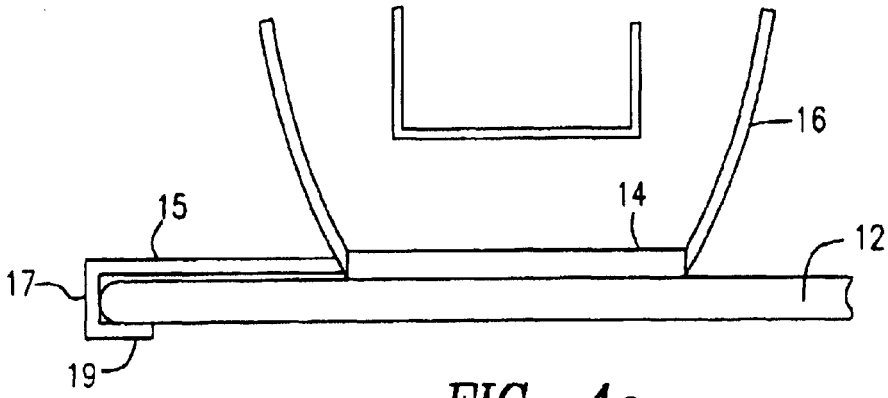
FIG. 4*a* and FIG. 4*b* depict other means for attachment of the wine holder to a table by means of an extension from the support base.
Figure 4B:
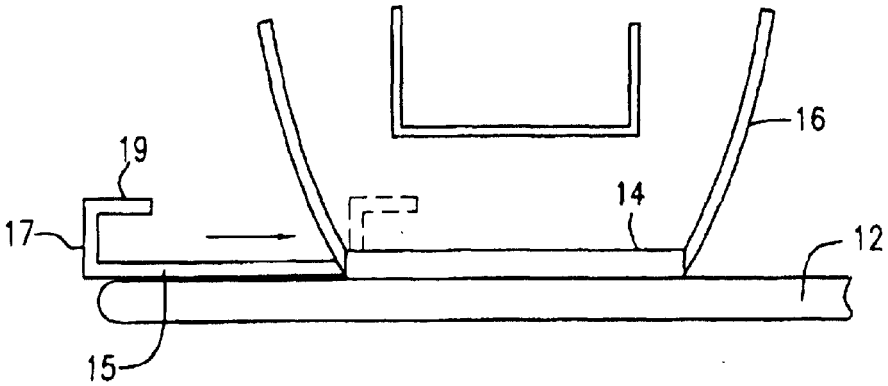

FIG. 4 depicts another side view of support base 14 and portions of support frame member 16 wherein an extension arm 15, which can be permanent or retractable into the support base, reaches to the edge of the table top and can be clamped to the table by one or more means. Alternatively, the end of the extension can be bent over to form a vertical portion 17 touching the table edge, and a horizontal portion 19 which extends backwards under the table towards the table center and hold the support base in place by friction or clamping means not shown. If extension 15 is retractable into the support base, then, of course, the extension can be fabricated to swivel 180 degrees so that any bent portion would face upright as shown in FIG. 4*b* and could be retracted by sliding into the support base to the position shown by the dotted lines.

Figure 7A:
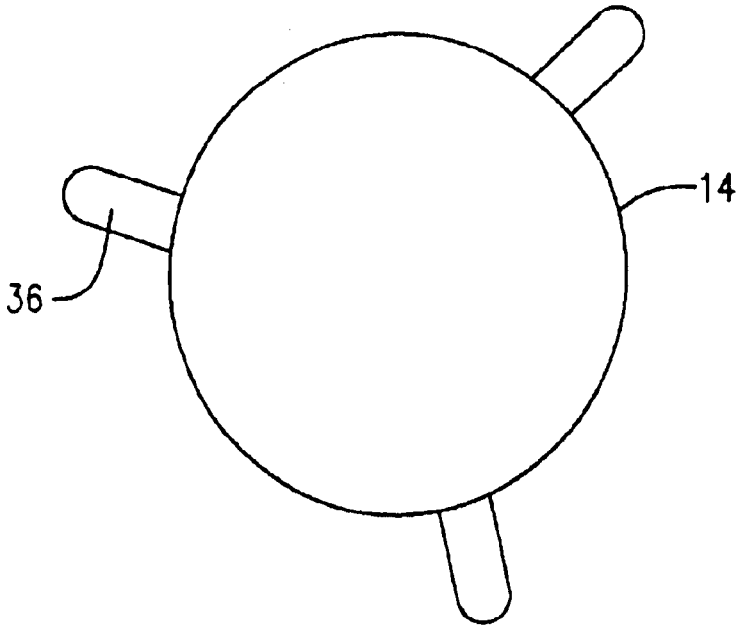
FIGS. 7*a* and 7*b* depict different configurations of the support base which will maintain the holder firmly on the table.
Figure 7B:
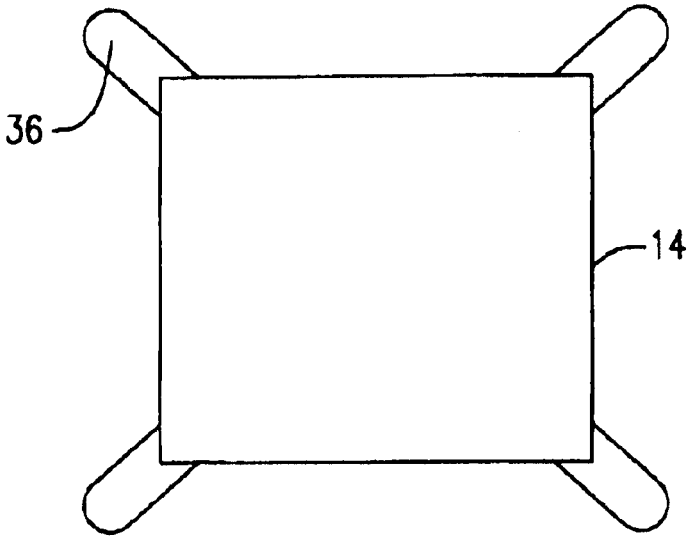

FIG. 7*a* and FIG. 7*b* depict a top view of various configurations of support base 14 which need not be affixed to the table but are sufficiently heavy or extend outwardly so as to stabilize the holder on a table top. Three or more fixed support extensions 36 such as shown can aid to stabilize the holder. In some embodiments, the bottom of the support base can be raised slightly and only the support extensions 36 in the form of feet needed to maintain the wine holder in the upright position without fear of tipping.

In one preferred embodiment of this invention, the table top wine holder is of such dimensions to easily accommodate an average 750 milliliter wine bottle, which is the size of the majority of wines that are consumed in restaurants and at home. In such cases, the wine receptacle is tubular in shape and has a dimension of from about 8 to about 12 inches in height and at least about 4 inches or greater in width. For those instances wherein there is a need to accommodate wine bottles of a larger size, receptacles of different sizes can be employed. Hence, it is contemplated that the wine holder of the present invention can accommodate receptacles of different sizes. Of course, since the support frame loops over the top of the bottle, the size of the receptacle and wine bottle itself will determine the overall size of the wine holder itself.

For the standard 750 milliliter wine bottle which is about 12 inches in height, the height of the wine holder should be at least about 2 inches and preferably several inches higher than the top of the bottle or any cork which might have been replaced in the bottle when the bottle is in the receptacle. This will insure that the upper most portion of the holder clears the top of the wine bottle when the receptacle is tilted away from the vertical to access the wine.

Accordingly, it is preferred that the overall height of the wine holder support frame member for the standard size wine bottle is at least about 14 or 15 inches above the support base. Since in a preferred embodiment of this invention the support frame member is oval in shape, the widest portion of the frame arms is at least about 6 inches from side to side to allow tilting of the wine bottle and room for the horizontal rods which support the receptacle.

The horizontal rods can be of a diameter of about one-eighth inch or larger and extend horizontally and outwardly from the opposite sides of the wine receptacle. The rods are attached to the support frame member and can extend through the member if desired, at a point about one half the height of the frame, usually its widest point. The rods are affixed to the frame member in a manner permitting them to rotate about their axis in a horizontal plane in order to tilt the receptacle away from the vertical. Locking means, such as a thumb screw or similar device can be affixed at one or both outer ends of the rods to hold the receptacle in the tilted or upright position. While the horizontal support means have been described as rods, other configurations such as rectangular plates, square shaped rods, and the like can be employed as long as they can swivel where attached to the support frame and firmly hold the receptacle.

Since a main objective of the present invention is to not only provide a wine holder which is quite stable on a table top, but to maintain the wine in a chilled state, the wine receptacle contains a removable tubular sleeve, closed at the bottom and which fits against the interior wall of the receptacle and and in close proximity to the outer surface of the wine bottle when contained therein. Hence, the outer width of the tubular sleeve will be slightly less that the inner surface of the receptacle, and the inner width of the tubular sleeve slightly greater than the width of the wine bottle. Thus, the greater the distance between the inner and outer walls of the tubular sleeve, the larger the amount of coolant which can be accommodated. In practice, for a tubular sleeve of about 12 inches in height, the space between the inner and out walls of the sleeve should be at last about one-quarter inch, and preferably much wider to insure adequate cooling. The tubular sleeve is filled with a nontoxic liquid, such as water, water-glycol mixtures, and the like, which can be easily frozen by placing in the freezer compartment of a refrigerator. After removal from the freezer the coolant will remain in a frozen or semi-frozen state for a period of time in which the chilled wine can be enjoyed throughout the course of a meal.

Alternatively, in place of a coolant which requires freezing, the tubular receptacle can be in the form of a thermos having a vacuum within sealed walls. The wine bottle itself can be chilled and its chilled state maintained during the course of the meal while in the receptacle.

In a preferred embodiment of the present invention, the support base can be affixed to the table top by a variety of means. For example, as shown in FIG. 3 a clamping device, such as a "C" clamp, can be employed to securely hold the wine holder to the table top. If the table top is smooth, such as glass, plastic or wood top, the underside of the support base can be fitted with suction devices to maintain the holder on the table surface.

In up-scale restaurants or at home when the table is covered with a table cloth suction devices would undoubtedly not work and other methods of maintaining the holder in a steady position. such as the "C" clamp devise noted above can be employed. For example, in another embodiment the support base can contain one or more hollow chambers accessible and sealable from the outside into which water or other material can be placed to provide the necessary weight to maintain the holder firmly on the table. Also, the support base can be fabricated of different configurations which will render the holder stable without the need for mechanical attachments to the holder itself. For example, the width of the base can be such in comparison with the height of the wine holder to minimize any possibility of the holder tipping over. A circular shaped base support which has a width of about half the height of the wine holder is quite stable.

In another embodiment, it is also possible for the wine holder to have a support base which is other than circular in shape. For instance, the support base can be triangular or even have legs extending outwardly in the form of a tripod. In such instances, the bottom surface of the base need not rest on the table top as long as there are three or more feet or knobs extended from the base to support the wine holder in a stable manner. It should therefore be apparent that the support base of the holder of this invention can be fabricated in a variety of configurations as long as it provides the necessary stability to the wine holder itself while resting on a table top.

In a still further and preferred embodiment, the support base regardless of configuration, can have an extension such as a metal strip or rod which is fixed to, or extendible from and retractable into, the base and extends to the table edge where it can be clamped to the table itself. Alternatively, the end of the extension can be bent over to form a vertical portion over the edge of the table and a further bend at the end to form a clip extending horizontally around and under the table top where it can hold the wine holder in place by friction or by a spring-like device not shown in the drawings contained in the extension itself. Such a method for maintaining the wine holder in a stable position, as well as the clamping methods described above, would be helpful for wine holders used on ships where it may, due to weather conditions, require that the wine holder be more stable than on shore.

In those cases where the support base has an extension for securing the wine holder, the extension can be such as to be retractable into the support base. If the extension is of the type which ends in a "[" confirguration which grasps the table edge, it should be able to rotate 180 degrees so that the "[" shaped portion can be faced upwardly, and thus easily retracted into the base.

While it is preferred that the table top wine holder of this invention be fabricated from metal such as stainless steel, other materials can be used if desired. Preferably, at least the cylindrical receptacle and the removable cooling means should be composed of stainless steel. However, the holder can be composed of other metals, alloys, plastics, or combinations thereof. Depending upon the specific design and fabrication costs it is possible to use plastic which is then coated with metallic aluminum or other metal to provide a more desirable look. Of course, more expensive wine holders can be fabricated from silver or silver coated metals.

Although the invention has been illustrated by the preceding description, it is not to be construed as being limited to the materials disclosed therein, but rather the invention is directed to the generic area as hereinbefore disclosed.

What I claim is:

1. A wine holder which can be securely set on a table top in close proximity to, and for easy access by consumers, and which maintains wine contained therein at a temperature suitable for serving, said wine holder comprised of, in combination:

(a) a support base which can rest on a table top;

(b) at least one continuous, elongated support frame member which is configured so that the ends of the frame are affixed to the outer areas of the support base, providing at least one vertical loop over the base;

(c) horizontal support means rotatably attached to at least two vertical arms of the support frame and supporting within the loop a wine receptacle deposed between the arms of the support frame;

(d) means affixed to at least one of the support means to permit rotation of the wine receptacle from the vertical up to about 20 degrees away from the vertical to facilitate the removal of a wine bottle for dispensing wine to the consumers; and (e) removable cooling means associated with the wine receptacle for maintaining a wine bottle held within the receptacle at a temperature suitable for serving.

2. The wine holder of claim 1 wherein the support base is sufficiently heavy to maintain the wine holder with a full bottle of wine in a stable condition.

3. The wine holder of claim 1 wherein the support base contains means for affixing the holder to the table top.

4. The wine holder of claim 1 wherein the means are comprised of a device for clamping the holder to the table top.

5. The wine holder of claim 4 wherein the device is a "C" clamp.

6. The wine holder of claim 1 wherein the elongated support frame is oval in configuration with the two ends affixed to the support base.

7. The wine holder of claim 1 wherein the elongated support frame viewed from the top is triangular in shape and has three ends affixed to the outer upper surface of the support base and three arms intersecting at the top of the support frame.

8. The wine holder of claim 1 wherein the horizontal support means are rotatably attached to opposite arms of the the support frame, and thereby supporting the wine receptacle between said arms.

9. The wine holder of claim 1 wherein the wine receptacle is cylindrical in configuration and open at the top end.

10. The wine holder of claim 9 wherein the wine receptacle contains a tubular sleeve which fits against the inner wall of the wine receptacle for containing a coolant.

11. The wine holder of claim 9 wherein the wine receptacle is a gel which when frozen maintains a frozen or semi-frozen state for a period of time during which wine is served.

12. The wine holder of claim 1 wherein the support base is circular in configuration.

13. The wine holder of claim 1 wherein the support base is square in configuration with the ends of the support frame attached at to alternate corners of the base.

14. The wine holder of claim 1 wherein the support base is triangular in configuration.

15. The wine holder of claim 1 wherein the support frame is comprised of stainless steel.

16. The wine holder of claim 15 wherein the horizontal support means ar stainless steel rods attached to the cylindrical receptacle and to each arm of the support frame.

17. The wine holder of claim 16 wherein the stainless steel rods are rotatable so as to off-set the cylindrical receptacle from the vertical of up to about twenty degrees.

18. The wine holder of claim 17 wherein the rods have means for locking the cylindrical receptacle in an off-vertical position.

19. A method from providing wine on a table in close proximity to, and within easy reach of consumers which comprises placing on the table at which said consumers sit, the wine holder of claim 1.

20. A wine holder comprised of stainless steel and which can be securely set on a table top in close proximity to, and for easy access by consumers, and which maintains wine contained therein at a desired temperature suitable for serving, said wine holder comprised of, in combination:

(a) a circular support base which can rest on a table top and contain means for affixing the holder to the table;

(b) at least one continuous, elongated support frame member which is of oval configuration so that the two ends of the frame are affixed to the outer areas of the support base, providing a vertical oval shaped loop over the base, the top of the frame being higher than the height of a wine bottle;

(c) horizontal support means rotatably attached to at least two vertical arms of the support frame and supporting within the loop a wine receptacle deposed between the arms of the support frame;

(d) means affixed to at least one of the support means to permit rotation of the wine receptacle from the vertical up to about 20 degrees away from the vertical to facilitate the removal of a wine bottle for dispensing wine to the consumers; and (e) removable cooling means associated with the wine receptacle for maintaining a wine bottle held within the receptacle at a temperature suitable for serving.

* * * * *